US010647108B2

(12) United States Patent
Kanasugi

(10) Patent No.: US 10,647,108 B2
(45) Date of Patent: May 12, 2020

(54) IMAGE RECORDING APPARATUS

(71) Applicant: CANON KABUSHIKI KAISHA, Tokyo (JP)

(72) Inventor: Yuichiro Kanasugi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/371,558

(22) Filed: Apr. 1, 2019

(65) Prior Publication Data

US 2019/0299588 A1 Oct. 3, 2019

(30) Foreign Application Priority Data

Apr. 2, 2018 (JP) ..... 2018-071121

(51) Int. Cl.
*B41J 2/005* (2006.01)

(52) U.S. Cl.
CPC ..... *B41J 2/0057* (2013.01)

(58) Field of Classification Search
CPC ..... B41J 2/0057
See application file for complete search history.

(56) References Cited

U.S. PATENT DOCUMENTS 5,420,048 A * 5/1995 Kondo ..... H01L 29/66772 148/DIG. 150
6,382,102 B1 * 5/2002 Herrmann ..... B41N 10/04 101/217
6,645,601 B1 * 11/2003 Serain ..... B41N 10/06 428/121
2002/0078840 A1 * 6/2002 Gaffney ..... B41F 27/00 101/217
2003/0066449 A1 * 4/2003 Iwasaki ..... B32B 5/26 101/376
2003/0183984 A1 * 10/2003 Ogawa ..... B29B 13/023 264/322

FOREIGN PATENT DOCUMENTS

JP H11-291660 A 10/1999
WO WO 03/031196 * 4/2003 ..... B41N 5/26

* cited by examiner

*Primary Examiner* — Huan H Tran
(74) *Attorney, Agent, or Firm* — Venable LLP

(57) ABSTRACT

Provided is a transfer-type image recording apparatus including: a transfer body; a support member for a transfer body; and a support member for a recording medium, wherein the image recording apparatus further includes a buckling member satisfying the following formulae (1) to (3) arranged in at least one of a space between the transfer body and the support member for a transfer body, or a space between a recording medium and the support member for a recording medium:

$X1/X2 \leq 0.20$ Formula (1):

$(Y1/X1)/\{(Y2-Y1)/(X3-X1)\} \geq 5.0$ Formula (2):

$Y1<Y2$: Formula (3).

8 Claims, 3 Drawing Sheets

IMAGE RECORDING APPARATUS

BACKGROUND OF THE INVENTION

Field of the Invention

The present invention relates to an image recording apparatus.

Description of the Related Art

There has been known a transfer-type image recording apparatus configured to form an image by applying ink to a transfer body, and to transfer the image from the transfer body onto a recording medium to record the image. In the image recording apparatus, one factor that largely affects the image quality of the final image to be obtained on the recording medium is transfer efficiency at the time of the transfer of the image formed on the transfer body onto the recording medium. In order to improve the transfer efficiency, a method involving increasing a pressure for pressing the recording medium on which the image is formed, that is, a pressure at a nip between the transfer body and the recording medium has heretofore been investigated. In Japanese Patent Application Laid-Open No. H11-291660, there is a disclosure that a printing blanket having a function as a transfer body has a compressive layer that is formed of a porous oil-resistant rubber, such as a sponge rubber, and has a specific density and a specific thickness, below a surface printing layer, and hence applies a predetermined pressure to a printing paper.

In addition, it has been known that even in the tolerance range of a compression amount caused by a variation in apparatus or recording medium, when a transfer body has a compressive layer, a sharp change in pressure at transfer portion is suppressed.

SUMMARY OF THE INVENTION

The present invention is directed to provide an image recording apparatus having the following features: even at the time of abnormal operation, a load applied to the image recording apparatus is reduced, and hence the damage and deformation of the image recording apparatus are suppressed; and even in transfer at the time of normal operation, the apparatus has high transfer efficiency and hence can suppress a reduction in image quality.

According to one embodiment of the present invention, there is provided an image recording apparatus including: a transfer body; a support member for a transfer body configured to support the transfer body; an image forming portion configured to form an image by applying ink to the transfer body; a transfer portion configured to transfer the image formed on the transfer body onto a recording medium by applying a pressure to the image; and a support member for a recording medium configured to support the recording medium, wherein the image recording apparatus further includes a buckling member satisfying the following formula (1) to the following formula (3) in at least one of a space between the transfer body and the support member for a transfer body, or a space between the recording medium and the support member for a recording medium:

$$X1/X2 \leq 0.20 \quad \text{Formula (1):}$$

$$(Y1/X1)/\{(Y2-Y1)/(X3-X1)\} \geq 5.0 \quad \text{Formula (2):}$$

$$Y1 < Y2 \quad \text{Formula (3):}$$

in the formulae (1) to (3), Y1 represents a pressure at the transfer portion at a time of normal operation, Y2 represents a pressure at the transfer portion at a time of abnormal operation, X1 represents a compression amount of the buckling member for the pressure at the transfer portion at the time of normal operation, X2 represents a compression amount of the transfer body for the pressure at the transfer portion at the time of normal operation, and X3 represents a compression amount of the buckling member for the pressure at the transfer portion at the time of the abnormal operation.

Further features of the present invention will become apparent from the following description of exemplary embodiments with reference to the attached drawings.

DESCRIPTION OF THE EMBODIMENTS

Figure 1A:
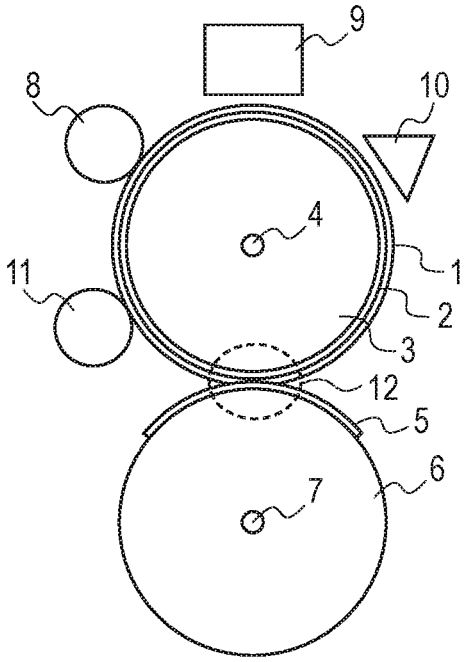
FIG. 1A is a schematic view for illustrating an example of the state of an image recording apparatus according to the present invention, and is a schematic view for illustrating an example of the state of the apparatus at the time of normal operation.

According to an investigation by the inventors of the present invention, in the method described in Japanese Patent Application Laid-Open No. H11-291660, at the time of abnormal operation in which a pressure excessively larger than a pressure at the time of normal operation is produced, a large load is applied to an image recording apparatus in some cases. The term "abnormal operation" as used herein refers to, for example, a case in which the multi-feeding of recording media is performed, or a case in which a transfer pressure is set to a value different from that derived from the thickness of a recording medium to be used (hereinafter sometimes referred to as "missetting of the thickness of a recording medium"). Further, depending on the magnitude of the load, a portion of the image recording apparatus to which an excessive pressure is applied is damaged in some cases.

A method of reducing the load applied to the apparatus in such abnormal operation is, for example, to use a soft transfer body. However, when the soft transfer body is used, at the time of normal operation, a pressure reduces and hence transfer efficiency reduces in some cases. In addition, when the compression amount of the soft transfer body is increased for increasing the transfer pressure by the transfer body, the deformation of the transfer body at the time of transfer becomes larger to cause the deformation of the final image to be recorded on a recording medium, and hence its image quality reduces in some cases.

The inventors of the present invention have made extensive investigations for the following purposes: even at the time of abnormal operation, a load applied to an image recording apparatus is reduced, and hence the damage and deformation of the image recording apparatus are suppressed; and even in transfer at the time of normal operation, high transfer efficiency is achieved and hence a reduction in image quality is suppressed. Thus, the inventors have reached the present invention.

The present invention is described in detail below by way of embodiments.

First, the inventors of the present invention have investigated a characteristic needed for obtaining high transfer efficiency in a transfer-type image recording apparatus. As a result, the inventors have found that it is important to increase a pressure produced by the compression of a transfer body. Specifically, an increase in hardness of a sponge rubber to be used as the compressive layer of the transfer body, or an increase in compression amount of the transfer body at the time of transfer has been an effective method of increasing the transfer pressure.

However, the inventors have found that at the time of abnormal operation, a large load is applied to the image recording apparatus in some cases. Of such cases, when an excessively large pressure is produced by an increase in compression amount of the transfer body due to the multi-feeding of recording media or the missetting of the thickness of the recording medium, the image recording apparatus is damaged in some cases. In addition, when the compression amount of the transfer body is increased, the deformation of the transfer body at the time of normal operation becomes larger to reduce the image quality of the final image to be recorded on the recording medium in some cases.

The inventors of the present invention have made various investigations on conditions needed for solving the above-mentioned technical problems, and as a result, have reached the construction of an image recording apparatus according to the present invention.

The image recording apparatus according to the present invention includes a transfer body, a support member for a transfer body, a support member for a recording medium, an image forming portion, and a transfer portion, and further includes a buckling member in at least one of a space between the transfer body and the support member for a transfer body, or a space between a recording medium and the support member for a recording medium.

The image forming portion includes a device configured to form an image by applying ink to the transfer body. The transfer portion includes a device configured to transfer the image formed on the transfer body onto the recording medium by applying a pressure (hereafter sometimes referred to as "transfer pressure") to the image under a state in which the image is sandwiched between the transfer body and the recording medium.

When the transfer body is separated from the recording medium onto which the image has been transferred, a recorded product (printed product) formed of the recording medium having the transferred image is supplied.

The buckling member to be arranged in the image recording apparatus according to the present invention satisfies the following formula (1) to the following formula (3):

$$X1/X2 \leq 0.20 \quad \text{Formula (1):}$$

$$(Y1/X1)/\{(Y2-Y1)/(X3-X1)\} \geq 5.0 \quad \text{Formula (2):}$$

$$Y1 < Y2 \quad \text{Formula (3):}$$

in the formulae (1) to (3), Y1 represents a pressure at the transfer portion at a time of normal operation, Y2 represents a pressure at the transfer portion at a time of abnormal operation, X1 represents a compression amount of the buckling member for the pressure at the transfer portion at the time of normal operation, X2 represents a compression amount of the transfer body for the pressure at the transfer portion at the time of normal operation, and X3 represents a compression amount of the buckling member for the pressure at the transfer portion at the time of the abnormal operation.

The abnormal operation of the transfer portion is operation deviating from the normal operation of the transfer portion, that is, transfer operation in the normal actuation of the apparatus at a preset transfer pressure or in a preset transfer pressure range to cause a pressure increase specified by the formula (3).

The mechanism via which the effects of the present invention are obtained by the above-mentioned construction is described below.

Deformation occurring in the buckling member at the transfer portion at the time of normal operation is smaller than deformation occurring in the transfer body, and hence falls within the range of the formula (1).

In the deformation in the range, the pressure at the transfer portion can be effectively controlled by the compression characteristics of the transfer body. Accordingly, even in the tolerance range of the compression amount of the buckling member caused by a variation in apparatus or recording medium, a sharp change in pressure at the transfer portion is suppressed. In addition, in the deformation in the range, permanent deformation hardly occurs in the buckling member, and hence the member can be repeatedly used.

Meanwhile, in order to prevent or alleviate damage to the apparatus, an increase in transfer pressure with respect to the compression amount of the buckling member at the time of the abnormal operation needs to be more gradual than that at the time of the normal operation is. In the range of the formula (2) out of such cases, the effects of the present invention are obtained.

When the physical properties of the respective members forming the transfer portion synergistically affect each other like the foregoing mechanism, the effects of the present invention can be achieved.

One embodiment of the image recording apparatus according to the present invention is described in more detail below.

<Transfer Body and Support Member for Transfer Body>

The transfer body serves as a substrate which holds a liquid composition to be described later and the ink, and on which an image is recorded. The transfer body is, for example, a transfer body including: a reinforcing layer for imparting, to the transfer body, strength needed for handling or fixation to the support member for the transfer body; a compressive layer for controlling the transfer pressure in accordance with the compression amount of the transfer body; and a recording layer on which an image is recorded. The reinforcing layer, the compressive layer, and the recording layer may be integrated with one another.

Examples of the shape of the transfer body may include a sheet shape, a roller shape, a drum shape, a belt shape, and an endless web shape. In addition, the shape and size of the transfer body may be appropriately set in accordance with the shape and size of the recording medium.

The support member for a transfer body configured to support the transfer body is required to have some degree of strength from the viewpoints of its conveyance accuracy and durability. A material for the support member is preferably, for example, a metal, a ceramics, or a resin. Of those, aluminum, iron, stainless steel, an acetal resin, an epoxy resin, polyimide, polyethylene, polyethylene terephthalate, nylon, polyurethane, silica ceramics, and alumina ceramics are preferred. When the support member is formed of any such material, rigidity and dimensional accuracy that can resist pressurization at the time of transfer can be secured. In addition, inertia at the time of operation is alleviated, and hence the responsiveness of the control can be improved. Those materials may be used alone or in combination thereof. The shape and size of the support member for a transfer body only need to be selected in accordance with the shape and size of the transfer body.

The reinforcing layer of the transfer body is required to have some degree of strength from the viewpoints of its conveyance accuracy and durability. The reinforcing layer is preferably, for example, a cloth or a film. A material for the cloth is, for example, cotton, polyester, polyimide, or nylon. A material for the film is, for example, polyethylene terephthalate or polyimide.

The thickness of the reinforcing layer only needs to be such a thickness that a target function of the reinforcing layer can be obtained, and is not limited. The thickness of the reinforcing layer is preferably selected from the range of from 1.0×10−2 mm or more to 5.0 mm or less.

The compressive layer of the transfer body is preferably a rubber including pores (sponge rubber). The pores may include one of open cells communicating to each other and closed cells independent of each other, or a mixed state of the cells. A porous compressive layer having many closed cells is preferred for alleviating flattening due to the transfer pressure. A material for the rubber for the compressive layer is preferably a polybutadiene-based rubber, a nitrile-based rubber, a chloroprene-based rubber, a silicone-based rubber, a fluorine-based rubber, a fluorosilicone-based rubber, a urethane-based rubber, a styrene-based elastomer, an olefin-based elastomer, a vinyl chloride-based elastomer, an ester-based elastomer, or an amide-based elastomer.

The thickness of the compressive layer only needs to be such a thickness that a target function of the compressive layer can be obtained, and is not limited. The thickness of the compressive layer may be preferably selected from the range of from $1.0\times10^{-2}$ mm or more to 5.0 mm or less.

A material for the recording layer of the transfer body is preferably, for example, a metal, a ceramics, or a resin. Of those, a polybutadiene-based rubber, a nitrile-based rubber, a chloroprene-based rubber, a silicone-based rubber, a fluorine-based rubber, a fluorosilicone-based rubber, a urethane-based rubber, a styrene-based elastomer, an olefin-based elastomer, a vinyl chloride-based elastomer, an ester-based elastomer, an amide-based elastomer, polyether, polyester, polystyrene, polycarbonate, a siloxane compound, and a perfluorocarbon compound are preferred. In addition, the recording layer may be formed by laminating a plurality of materials. Examples thereof include a material obtained by laminating a silicone rubber on a urethane rubber sheet, a material obtained by laminating a silicone rubber on a polyethylene terephthalate film, a material obtained by forming a siloxane compound into a film on a urethane rubber sheet, and a material obtained by forming a siloxane compound into a film on a silicone rubber sheet.

The thickness of the recording layer only needs to be such a thickness that a target function of the recording layer can be obtained, and is not limited. The thickness of the recording layer may be preferably selected from the range of from $1.0\times10^{-4}$ mm or more to 2.0 mm or less.

The transfer pressure that affects transfer efficiency is preferably controlled mainly by the compression amount of the transfer body. The pressure is more preferably controlled by the compression amount of the compressive layer out of the compression amount. Accordingly, the compression amounts of the support member for a transfer body and the support member for a recording medium that the transfer pressure reaches are preferably sufficiently small as compared to the compression amount of the compressive layer. Although the compression amount of the recording medium varies depending on the characteristics of the recording medium to be used, the compression amount of the compressive layer is preferably sufficiently large as compared to the compression amount of the recording medium to be used. Similarly, the compression amount of the buckling member at the transfer pressure at the time of the normal operation is also preferably sufficiently small as compared to the compression amount of the compressive layer. The surface of the transfer body, that is, the surface of the recording layer may be subjected to a surface treatment before use. Examples of the surface treatment include a flame treatment, a corona treatment, a plasma treatment, a polishing treatment, a roughening treatment, an active energy ray irradiation treatment, an ozone treatment, a surfactant treatment, and a silane coupling treatment. The surface may be subjected to a combination of two or more of those treatments before use.

<Liquid Composition>

The image recording apparatus may include a liquid composition applying portion configured to apply a liquid composition to the transfer body for such purposes as described below: the fixation of an image onto the transfer body and an improvement in quality of the image; the control of the gloss of the final image to be obtained on the recording medium; and an improvement in transfer efficiency onto the recording medium.

Examples of the liquid-applying system of an applying device to be used in the liquid composition applying portion include: application systems, such as a roller coating system, a bar coating system, and a spray coating system; and an inkjet system.

The application of the liquid composition may be performed at at least one of the following timings: before the application of the ink to the transfer body; and after the application of the ink. In addition, the ink and the liquid composition are preferably applied to the transfer body so that a region to which the liquid composition is applied and a region to which the ink is applied may overlap each other at least partially.

Although the liquid composition may be colored to the extent that the image recorded with the ink is not affected, the composition is preferably colorless, opaque white, or white. Accordingly, the ratio (maximum absorbance/minimum absorbance) of the maximum absorbance of the composition to the minimum absorbance thereof in the wavelength region of from 400 nm to 800 nm serving as the wavelength region of visible light is preferably 1.0 or more to 2.0 or less. The foregoing means that the composition is substantially free of any absorbance peak in the wavelength region of visible light, or even if the composition has a peak, its peak intensity is extremely small. Further, the liquid composition is preferably free of any coloring material. Any such absorbance only needs to be measured by using an undiluted liquid composition and Hitachi Double-Beam Spectrophotometer U-2900 (manufactured by Hitachi High-Technologies Corporation). At this time, the absorbance may be measured after the liquid composition has been diluted.

(Reactant)

When functions of fixing an image to the transfer body and improving the quality of the image are imparted to the liquid composition, a reactant that deposits or agglomerates the components of the ink (e.g., a coloring material and a resin) is used as a component of the liquid composition. A substance conventionally known as a reactant that suppresses bleeding and beading at the time of image formation, or a substance that may be utilized as a reactant may be used as the reactant. Of those, at least one kind selected from a polyvalent metal ion, an organic acid, and a cationic polymer is preferably used. Further, at least one kind selected from the polyvalent metal ion and the organic acid is more preferably used because the rate at which the components of the ink are deposited and agglomerated increases. It is also preferred that a plurality of kinds of reactants be incorporated into the liquid composition.

Specific examples of the polyvalent metal ion may include: divalent metal ions, such as $Ca^{2+}$, $Cu^{2+}$, $Ni^{2+}$, $Mg^{2+}$, $Sr^{2+}$, $Ba^{2+}$, and $Zn^{2+}$; and trivalent metal ions, such as $Fe^{3+}$, $C^{3+}$, $Y^{3+}$, and $Al^{3+}$. The polyvalent metal ion may be added in the form of a salt, such as a hydroxide or a chloride, to the liquid composition, and may be used as an ion produced by dissociation. The content (% by mass) of the polyvalent metal ion is preferably 3% by mass or more to 99% by mass or less, more preferably 3% by mass or more to 90% by mass or less with respect to the total mass of the liquid composition.

In addition, specific examples of the organic acid may include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, and dioxysuccinic acid.

In addition, specific examples of the cationic polymer may include polyallylamine, a dicyandiamide resin, polyethyleneimine, and polyacrylamide.

The content (% by mass) of the reactant is preferably 3% by mass or more to 99% by mass or less with respect to the total mass of the liquid composition.

(Particles)

The liquid composition may contain particles for controlling the gloss of the final image and improving the transfer efficiency. At least one kind of particles conventionally known as particles for controlling the gloss of the final image and improving the transfer efficiency, or conventionally known resin particles and inorganic particles that may be utilized for such purposes may be used as the particles. It is also preferred that a plurality of kinds of particles be incorporated into the liquid composition.

Specific examples of the resin particles may include a polyolefin wax, such as polyethylene or polypropylene, a paraffin wax, a carnauba wax, polyurethane, and acryl. Specific examples of the inorganic particles may include alumina, silica, zirconia, and titania.

In addition, the average particle diameter of the particles is preferably 0.001 μm or more to 10 μm or less. When the average particle diameter is less than 0.001 μm, the state of dispersion of the particles in the liquid composition becomes unstable, and hence the application uniformity of the composition reduces in some cases. When the average particle diameter is more than 10 μm, in-plane unevenness at the time of the application of the composition onto the transfer body becomes remarkable in some cases. The average particle diameter of the particles is an average particle diameter measured by dynamic light scattering.

(Surfactant)

The liquid composition may contain a surfactant. Conventionally known compounds may each be used as the surfactant; the composition preferably contains at least one kind selected from a fluorine-based surfactant and a silicone-based surfactant out of the compounds. The fluorine-based surfactant means a surfactant having a fluoroalkyl group, and the silicone-based surfactant means a surfactant having a dimethylsiloxane group. In addition, a plurality of surfactants may be used in combination.

Specific examples of the fluorine-based surfactant include F-444 (product name, manufactured by DIC Corporation) and Zonyl FSO-100 (product name, manufactured by Sigma-Aldrich) serving as perfluoroalkyl ethylene oxide adducts. In addition, specific examples of the silicone-based surfactant include BYK348 and BYK349 (product names, each manufactured by BYK-Chemie) serving as polyether-modified siloxane compounds.

In addition, the content (% by mass) of the surfactant is preferably 0.1% by mass or more to 50% by mass or less with respect to the total mass of the liquid composition.

(Aqueous Medium)

Water or an aqueous medium serving as a mixed solvent of water and a water-soluble organic solvent may be used as the liquid medium of the liquid composition. The content (% by mass) of the water-soluble organic solvent is preferably 3.0% by mass or more to 50.0% by mass or less with respect to the total mass of the liquid composition. Solvents that have heretofore been generally used may each be used as the water-soluble organic solvent. Examples thereof include: alcohols; glycols; alkylene glycols each having an alkylene group having 2 to 6 carbon atoms; polyethylene glycols; nitrogen-containing compounds; and sulfur-containing compounds. Those water-soluble organic solvents may be used alone or in combination thereof as required. Deionized water (ion-exchanged water) is preferably used as the water. The content (% by mass) of the water is preferably 50.0% by mass or more to 95.0% by mass or less with respect to the total mass of the liquid composition.

(Other Components)

The liquid composition may contain a water-soluble organic compound that is solid at normal temperature in addition to the above-mentioned components as required, and examples thereof include: polyhydric alcohols, such as trimethylolpropane and trimethylolethane; and urea and urea derivatives, such as ethylene urea. Further, the liquid composition may contain any one of various additives, such as a pH adjuster, a rust inhibitor, an antiseptic, a fungicide, an antioxidant, an anti-reducing agent, an evaporation accelerator, a chelating agent, a lubricant, and a resin, as required. The content (% by mass) of those materials is preferably 1% by mass or more to 30% by mass or less with respect to the total mass of the liquid composition.

The liquid composition may be prepared as a treatment liquid having at least one kind of the following functions by selecting its composition: the fixation of an image onto the transfer body and an improvement in quality of the image; the control of the gloss of the final image to be obtained on the recording medium; and an improvement in transfer efficiency onto the recording medium. For example, the composition may be used as a reaction liquid containing a reactant, a treatment liquid containing particles, which is used for gloss control and/or an improvement in transfer efficiency, or a treatment liquid having the functions of both of the reaction liquid and the treatment liquid. In addition, the following procedure may be adopted: the reaction liquid containing a reactant and the treatment liquid containing particles, which is used for gloss control and/or an improvement in transfer efficiency, are separately prepared, and the liquids are used in appropriate combination.

[Liquid Removing Portion for Liquid Composition]

After the application of the liquid composition to the transfer body, liquid component removal from the liquid composition in which a liquid component is removed from the liquid composition applied to the transfer body may be performed. When at least part of the liquid component of the liquid composition is removed, the film thickness of the liquid composition can be reduced. As a result, a reduction in image quality due to the movement of an ink droplet applied in image formation on the liquid composition can be more effectively suppressed. Further, in the removal of the liquid component from the liquid composition, an excess liquid is preferably removed by drying the liquid composition on the transfer body. A removing device for removing the liquid component is, for example, a heating device, a blowing device configured to blow low-humidity air, a pressure reducing device configured to suck the liquid component through a pressure reduction, a mechanism needed for natural drying, or a device obtained by combining two or more of the devices. In addition, it is similarly preferred that a liquid composition originally free of any excess liquid component be applied onto the transfer body.

[Image Forming Portion]

The image forming system of the image forming device to be used in the image forming portion is, for example, an offset printing system, a dry electrophotographic system, a wet electrophotographic system, or an inkjet system. The inkjet system is preferably used as the image forming system. In particular, a system involving applying thermal energy to the ink to eject the ink from an ejection orifice of a recording head is more preferred.

A line head, a serial head, or the like may be used as a recording head of the inkjet system. In an inkjet head of a line head form, ink ejection orifices are arrayed in a direction perpendicular to the conveying direction of the transfer body (an axial direction in the case of a drum shape). In addition, the serial head is a head configured to scan the direction perpendicular to the conveying direction of the transfer body with itself to perform recording.

<Ink>

(Coloring Material)

The ink contains the coloring material. At least one kind of a pigment or a dye may be used as the coloring material. Conventionally known pigments and dyes may each be used as the pigment or the dye. The pigment is preferably used from the viewpoint of the water resistance of an image.

The content (% by mass) of the coloring material is preferably 0.5% by mass or more to 15.0% by mass or less, more preferably 1.0% by mass or more to 10.0% by mass or less with respect to the total mass of the ink.

When the pigment is used as the coloring material, the following pigments may each be utilized.

- A resin dispersion-type pigment using a resin as a dispersant (a resin-dispersed pigment using a resin dispersant, a microcapsule pigment containing pigment particles whose surfaces are each coated with a resin, or a resin-bonded pigment containing pigment particles whose surfaces each have an organic group containing a resin chemically bonded thereto).
- A self-dispersion-type pigment (self-dispersible pigment) containing pigment particles whose surfaces each have a hydrophilic group introduced thereto.

Pigments different from each other in dispersion method may be used in combination.

Carbon black or an organic pigment is preferably used as the pigment. In addition, the pigments may be used alone or in combination thereof.

When the pigment to be used in the ink is a resin dispersion-type pigment, a resin is used as a dispersant. The resin to be used as the dispersant preferably has both of a hydrophilic moiety and a hydrophobic moiety. Specific examples thereof include: an acrylic resin polymerized by using a monomer having a carboxyl group, such as acrylic acid or methacrylic acid; and a urethane resin polymerized by using a diol having an anionic group, such as dimethylolpropionic acid. In addition, the acid value of the resin to be used as the dispersant is preferably 50 mgKOH/g or more to 550 mgKOH/g or less. In addition, the weight-average molecular weight (Mw) of the resin to be used as the dispersant obtained by gel permeation chromatography (GPC) in terms of polystyrene is preferably 1,000 or more to 50,000 or less. In addition, the content (% by mass) of the resin dispersant in the ink is preferably 0.1% by mass or more to 10.0% by mass or less, more preferably 0.2% by mass or more to 4.0% by mass or less with respect to the total mass of the ink. In addition, the ratio of the content (% by mass) of the resin dispersant to the content (% by mass) of the pigment is preferably 0.1 times or more to 3.0 times or less in terms of mass ratio.

(Resin Particles)

The ink may contain resin particles. The resin particles have an effect of improving the scratch resistance or water resistance of the final image in addition to an effect of improving the strength of an image to improve its transfer efficiency. In addition, the particles have an effect of suppressing image deformation in which an ink droplet moves from a predetermined position in an image forming process.

The resin particles mean a resin dispersively present in a solvent under a state of having a particle diameter. The 50% cumulative volume-average particle diameter (D50) of the resin particles is preferably 10 nm or more to 1,000 nm or less. In addition, the D50 is more preferably 50 nm or more to 500 nm or less. The D50 is measured by the following method. A resin particle dispersion is diluted 50-fold (on a volume basis) with pure water, and its D50 is measured with UPA-EX150 (manufactured by Nikkiso Co., Ltd.) under the following measurement conditions: SetZero: 30 s, number of times of measurement: three times, measurement time: 180 seconds, and refractive index: 1.5.

In addition, the weight-average molecular weight of the resin particles obtained by gel permeation chromatography (GPC) in terms of polystyrene is preferably 1,000 or more to 2,000,000 or less.

Further, the minimum film forming temperature of the resin particles is preferably 20° C. or more to 120° C. or less. A method of measuring the minimum film forming temperature of the resin particles is in conformity with "Determination of minimum film forming temperature" of JIS K 6828-2.

Any particles may be used as the resin particles in the ink as long as the particles satisfy the above-mentioned definition of the resin particles. Any monomer may be used as a monomer to be used in each of the resin particles as long as the monomer can be polymerized by, for example, an emulsion polymerization method, a suspension polymerization method, or a dispersion polymerization method. Examples thereof include acrylic, vinyl acetate-based, ester-based, ethylene-based, urethane-based, synthetic rubber-based, vinyl chloride-based, vinylidene chloride-based, and olefin-based resin particles depending on differences in the monomer. Of those, acrylic resin particles and urethane resin particles are preferably used.

Examples of a monomer that may be used for preparing the acrylic resin particles include: an α,β-unsaturated carboxylic acid, such as (meth)acrylic acid, maleic acid, crotonic acid, angelic acid, itaconic acid, or fumaric acid, and a salt thereof; an ester compound of an α,β-unsaturated carboxylic acid, such as ethyl (meth)acrylate, methyl (meth) acrylate, butyl (meth)acrylate, methoxyethyl (meth)acrylate, ethoxyethyl (meth)acrylate, diethylene glycol (meth)acrylate, triethylene glycol (meth)acrylate, tetraethylene glycol (meth)acrylate, polyethylene glycol (meth)acrylate, methoxydiethylene glycol (meth)acrylate, methoxytriethylene glycol (meth)acrylate, methoxytetraethylene glycol (meth)acrylate, methoxypolyethylene glycol (meth)acrylate, cyclohexyl (meth)acrylate, isobornyl (meth)acrylate, N,N-dimethylaminopropyl (meth)acrylate, monobutyl maleate, or dimethyl itaconate; an alkylamide compound of an α,β-unsaturated carboxylic acid, such as (meth)acrylamide, dimethyl (meth)acrylamide, N,N-dimethylethyl (meth)acrylamide, N,N-dimethylpropyl (meth)acrylamide, isopropyl (meth)acrylamide, diethyl (meth)acrylamide, (meth)acryloylmorpholine, maleic acid monoamide, or crotonic acid methylamide; an α,β-ethylenically unsaturated compound having an aryl group, such as styrene, α-methylstyrene, vinyl phenylacetate, benzyl (meth)acrylate, or 2-phenoxyethyl (meth)acrylate; and an ester compound of a polyfunctional alcohol, such as ethylene glycol diacrylate or polypropylene glycol dimethacrylate.

Each of the resin particles may be a homopolymer obtained by polymerizing a single monomer, or may be a copolymer obtained by polymerizing two or more kinds of monomers. When each of the resin particles is a copolymer, the copolymer may be a random copolymer or a block copolymer. Of those, resin particles each using a hydrophilic monomer and a hydrophobic monomer are preferred. Examples of the hydrophilic monomer include an α,β-unsaturated carboxylic acid and a salt thereof, and examples of the hydrophobic monomer include an ester compound of an α,β-unsaturated carboxylic acid and an α,β-ethylenically unsaturated compound having an aryl group.

Urethane resin particles are resin particles synthesized by causing a polyisocyanate serving as a compound having two or more isocyanate groups and a polyol compound serving as a compound having two or more hydroxyl groups to react with each other. Any urethane resin particles obtained by causing a known polyisocyanate compound and a known polyol compound to react with other may be used as long as the particles satisfy the above-mentioned conditions of the resin particles.

Meanwhile, examples of the structures of the resin particles include resin particles each having a single-layer structure and resin particles each having a double-layer structure, such as a core-shell structure. The resin particles each having a double-layer structure are preferably used. In particular, resin particles each having a core-shell structure are more preferably used. When the resin particles each have a core-shell structure, functions are clearly separated between a core portion and a shell portion. Such resin particles each having a core-shell structure have an advantage in that the particles can impart more functions to the ink than the resin particles each having a single-layer structure do.

The content (% by mass) of the resin particles in the ink is preferably 0.5% by mass or more to 40.0% by mass or less, more preferably 1.0% by mass or more to 30.0% by mass or less with respect to the total mass of the ink.

(Medium)

Water or an aqueous medium serving as a mixed solvent of water and a water-soluble organic solvent, or a nonaqueous medium may be used as a liquid medium for dispersing and/or dissolving the coloring material in the ink. Of those, an aqueous medium is particularly preferred. The content (% by mass) of the water-soluble organic solvent is preferably 3.0% by mass or more to 5.0% by mass or less with respect to the total mass of the ink. Solvents that have heretofore been generally used may each be used as the water-soluble organic solvent. Examples thereof include: alcohols; glycols; alkylene glycols each having an alkylene group having 2 to 6 carbon atoms; polyethylene glycols; nitrogen-containing compounds; and sulfur-containing compounds. Those water-soluble organic solvents may be used alone or in combination thereof as required. Deionized water (ion-exchanged water) is preferably used as the water. The content (% by mass) of the water is preferably 5.0% by mass or more to 95.0% by mass or less with respect to the total mass of the ink.

(Other Components)

The ink may contain a water-soluble organic compound that is solid at normal temperature in addition to the above-mentioned components as required, and examples thereof include: polyhydric alcohols, such as trimethylolpropane and trimethylolethane; and urea and urea derivatives, such as ethylene urea. Further, the ink may contain any one of various additives, such as a surfactant, a pH adjuster, a rust inhibitor, an antiseptic, a fungicide, an antioxidant, an anti-reducing agent, an evaporation accelerator, a chelating agent, and a resin, as required.

[Liquid Removing Portion for Image]

The image recording apparatus may include a liquid removing portion configured to remove a liquid component from the image formed in the image forming portion. When the image contains an excess liquid, a reduction in image quality of the image to be obtained may be caused by, for example, the overflow of the excess liquid in a transferring step. Therefore, the excess liquid is preferably removed from the image by the liquid removing portion. A method of removing the liquid with a liquid removing device to be used in the liquid removing portion is, for example, a method involving heating the liquid, a method involving blowing low-humidity air, a method involving reducing a pressure applied to the liquid, a natural drying method, or a method in which two or more of the methods are combined.

[Transfer Portion]

In the transfer portion, the transfer pressure is applied to press the recording medium against the image formed on the transfer body, and hence the image is transferred onto the recording medium. The transfer of the image onto the recording medium in the transfer portion is performed by: bringing the surface of the transfer body having formed thereon the image and the recording medium into close contact with each other; applying the transfer pressure to transfer the image onto the recording medium; and peeling the image transferred onto the recording medium from the transfer body. The image is recorded on the recording medium by the transferring step.

A mechanism for applying the transfer pressure may be, for example, a mechanism via which the support member for a transfer body and the support member for a recording medium can press against each other, or one of the members can press against the other, or a mechanism configured to adjust a distance between the members so that the transfer pressure can be applied. Of those mechanisms, a mechanism configured to adjust the distance between the support member for a transfer body and the support member for a recording medium, and to control the transfer pressure with the compression amount of the transfer body to be inserted therebetween is preferably used.

The compression amount may be adjusted by selecting the distance between the support members configured to regulate the thickness of a laminated product of the transfer body and the recording medium in consideration of the thicknesses of the transfer body and the recording medium. In order to obtain more satisfactory transfer efficiency of the image and more satisfactory image quality of the image after the transfer, the compression amount X2 of the transfer body at the transfer pressure at the time of the normal transfer is preferably $1.0\times10^{-2}$ mm or more to $8.0\times10^{-1}$ mm or less, more preferably $5.0\times10^{-2}$ mm or more to $5.0\times10^{-1}$ mm or less.

The materials previously given as the examples of the material for the support member for a transfer body may each be similarly used as a material for the support member for a recording medium.

Roller-shaped support members are preferably used as the support members configured to fix the transfer body and the recording medium. When the compression amount changes in a nip like compression between rollers, the term "compression amount" as used herein refers to the maximum value of the compression amount.

In order to stably obtain more satisfactory transfer efficiency and stably obtain the texture of the image by reducing damage to the transfer body, the pressure Y1 at the transfer portion at the time of the normal operation controlled by the compression amount of the transfer body is preferably 0.3 MPa or more to 5.0 MPa or less.

In addition, in recent years, in association with a growing demand for high-speed recording, even when the time period for which the transfer body and the recording medium are in contact with each other is short, the achievement of high transfer efficiency has been required. The contact time is preferably 1 millisecond or more to 100 milliseconds or less.

In the transferring step, the image before the contact with the recording medium or the image at the time of the transfer is preferably heated. A method of heating the image is, for example, a method involving heating the transfer body to a predetermined temperature, a method involving separately arranging a heater, or a method involving utilizing heat generation by infrared irradiation.

In addition, in the transferring step, the recording medium before the contact with the image or the recording medium at the time of the transfer is preferably heated or cooled to a predetermined temperature. A method of heating or cooling the recording medium is, for example, a method involving heating or cooling a container configured to stock the recording medium or a conveying member configured to convey the recording medium to the predetermined temperature, or a method involving separately arranging a heater or a chiller.

<Buckling Member>

The buckling member is arranged for the purpose of corresponding to a case in which the abnormal operation, that is, a situation that is not normal operation occurs. When the buckling member itself buckles at the time of the occurrence of a pressure excessively larger than a normal transfer pressure under a situation in which the abnormal operation, such as multi-feeding, occurs, a load to any other member forming the transfer portion can be prevented or alleviated. From such viewpoint, the buckling member is preferably arranged in, for example, a portion in the image recording apparatus that is liable to be damaged at the time of the occurrence of an excessively large pressure, such as the shaft or bearing of a transfer roller, the transfer body, the support member for a transfer body, or the support member for a recording medium. In the present invention, in consideration of, for example, the simpleness of the exchange of a part of the apparatus, the buckling member is arranged in at least one of the space between the transfer body and the support member for a transfer body, or the space between the recording medium and the support member for a recording medium.

When the buckled buckling member cannot be reused under a situation in which the abnormal operation, such as multi-feeding, occurs, only the buckling member only needs to be exchanged, and hence the image recording apparatus can be extremely easily restored by the exchange of the buckling member as compared to the case where each support member or the like of the image recording apparatus is damaged.

Meanwhile, the compression amount of the buckling member with respect to a pressure to be applied at the transfer portion at the time of the normal operation needs to be reduced in terms of the repetition durability of the buckling member itself.

As described above, while the compression amount needs to be reduced at the transfer portion at the time of the normal operation even when a pressure is applied, the buckling member needs to undergo large compressive deformation at the time of the application of a pressure at the transfer portion at the time of abnormal operation. The inventors of the present invention have revealed that both of those contradictory characteristics can be achieved by using a buckling member having such a characteristic as to satisfy the formula (1) to the formula (3). A relationship between the compression amount of each of the transfer body and the buckling member, and the pressure (transfer pressure) is described with reference to FIG. 3A to FIG. 3C.

Figure 3A:
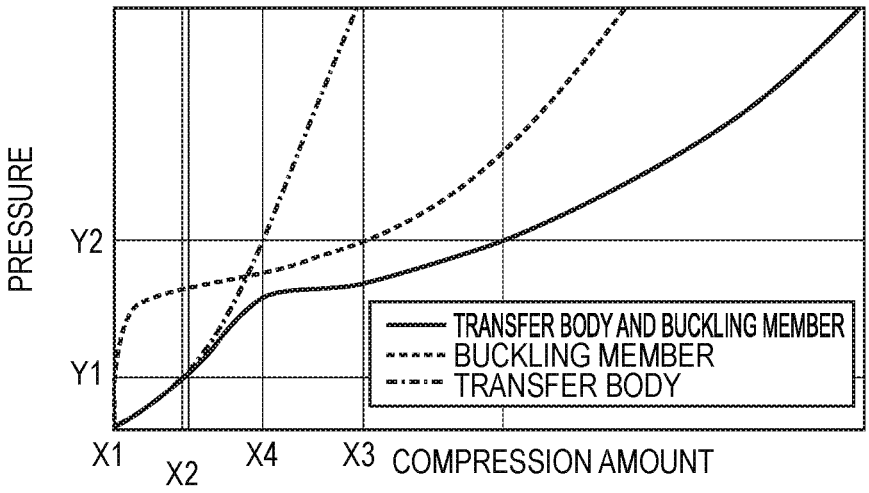
FIG. 3A is a schematic view for illustrating an example of a graph for showing a relationship between the compression amount of each of the transfer body and a buckling member, and a pressure at the time of normal operation.
Figure 3B:
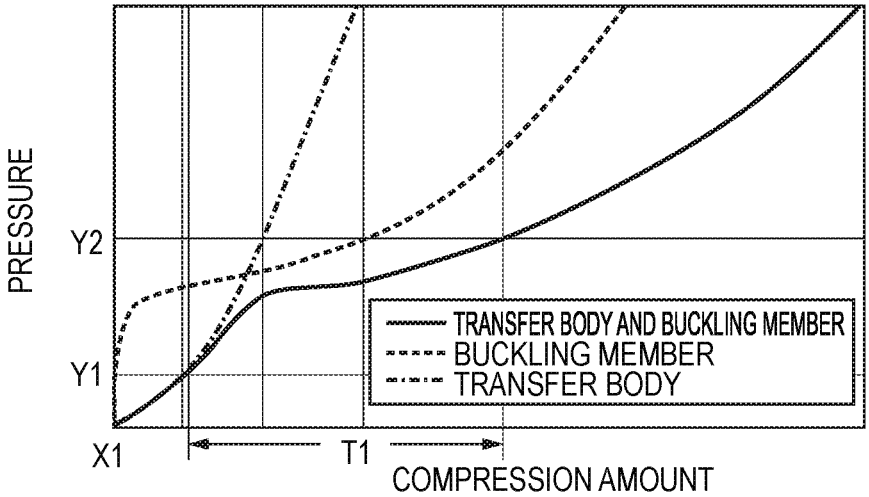
FIG. 3B is a schematic view for illustrating an example of a graph for showing a relationship between the compression amount of each of the transfer body and the buckling member, and the pressure when the abnormal operation is the multi-feeding of recording media.
Figure 3C:
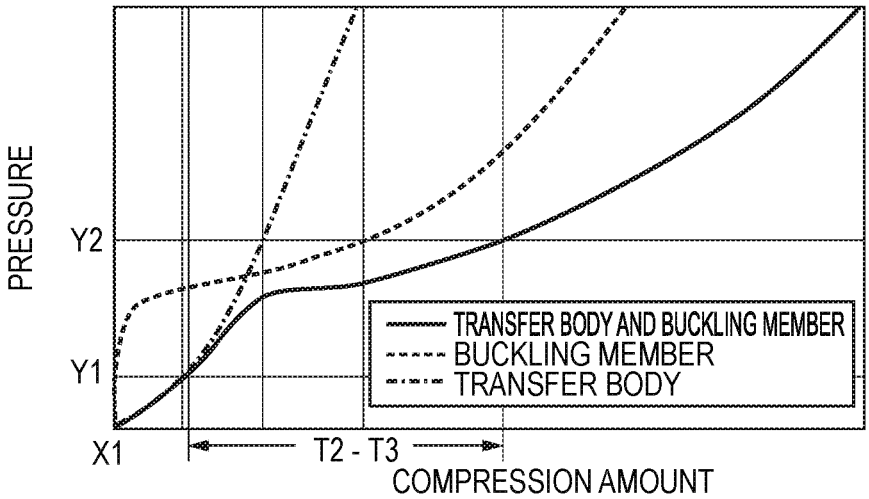
FIG. 3C is a schematic view for illustrating an example of a graph for showing a relationship between the compression amount of each of the transfer body and the buckling member, and the pressure when the abnormal operation is due to the missetting of the thickness of a recording medium.

In each of FIG. 3A to FIG. 3C, the solid line represents a relationship between a compression amount obtained from the buckling member and the transfer body, and the pressure, the chain line represents a relationship between a compression amount obtained only from the buckling member and the pressure, and the one dot chain line represents a relationship between a compression amount obtained only from the transfer body and the pressure.

FIG. 3A is a schematic view for illustrating an example of a graph for showing the relationship between the compression amount of each of the transfer body and the buckling member, and the pressure (transfer pressure) when the buckling member shows the characteristics of the formula (1) to the formula (3).

When the pressure to be applied to the transfer body and the buckling member at the time of the normal operation (the pressure at the transfer portion at the time of normal operation) is represented by Y1, the compression amount of the buckling member compressed by the pressure Y1 (the compression amount of the buckling member for the pressure at the transfer portion at the time of normal operation) is represented by X1, and the compression amount of the transfer body compressed by the pressure (the compression amount of the transfer body for the pressure at the transfer portion at the time of normal operation) is represented by X2. In the present invention, the X1 and the X2 satisfy the formula (1). The foregoing means that as illustrated in FIG. 3A, at the pressure Y1 at the transfer portion at the time of the normal operation, the transfer body is mainly compressed, and hence the compression of the buckling member by the transfer pressure is extremely small. That is, when the formula (1) is satisfied, permanent deformation of the buckling member at the time of the normal operation is suppressed from occurring.

Meanwhile, when the pressure to be applied to the transfer body and the buckling member at the time of the abnormal operation, such as the multi-feeding of the recording media (the pressure at the transfer portion at the time of abnormal operation), is represented by Y2, the compression amount of the buckling member compressed by the pressure Y2 (the compression amount of the buckling member for the pressure at the transfer portion at the time of the abnormal operation) is represented by X3, and the compression amount of the transfer body compressed by the pressure (the compression amount of the transfer body for the pressure at the transfer portion at the time of the abnormal operation) is represented by X4. In the present invention, the X3 satisfies the formula (2). The foregoing means that as illustrated in FIG. 3A, at the pressure Y2 at the time of the abnormal operation, not only the transfer body but also the buckling member is compressed. That is, when the formula (2) is satisfied, both of the transfer body and the buckling member deform, and as a result, damage to the transfer portion or the main body of the image recording apparatus by the pressure Y2 at the time of the abnormal operation can be suppressed.

In the present invention, at the time of the abnormal operation, a state in which the pressure (transfer pressure) to be applied to the transfer body and the buckling member becomes larger than that at the time of the normal operation is established, and hence the Y1 and the Y2 satisfy the formula (3).

With regard to the lower limit value of the ratio X1/X2, a relationship of $0<X1/X2$ is preferably satisfied. In addition, with regard to the range of the ratio X1/X2, a relationship of $0.10\leq X1/X2\leq 0.20$ is preferably satisfied.

In addition, when the abnormal operation is the multi-feeding of the recording media, the X3−X1 in the formula (2) described in the foregoing is a value obtained by subtracting a difference between the compression amount of the transfer body at the time of the abnormal operation and that at the time of the normal operation from an increment in thickness T1 of the recording media due to the multi-feeding to the transfer portion as compared to single feeding (i.e., T1−(X4−X2)). Therefore, when the abnormal operation is the multi-feeding of the recording media, a buckling member satisfying the following formula (4) instead of the formula (2) described in the foregoing is preferably used.

$$(Y1/X1)/[(Y2-Y1)/\{T1-(X4-X2)\}]\geq 5.0 \quad \text{Formula (4):}$$

In the formula (4), Y1 represents the pressure at the transfer portion at the time of normal operation, Y2 represents the pressure at the transfer portion at the time of abnormal operation, X1 represents the compression amount of the buckling member for the pressure at the transfer portion at the time of normal operation, X2 represents a compression amount of the transfer body for the pressure at the transfer portion at the time of normal operation, X4 represents a compression amount of the transfer body for the pressure at the transfer portion at the time of the abnormal operation, and T1 represents an increment in thickness of the recording media due to the multi-feeding to the transfer portion as compared to single feeding.

The multi-feeding of the recording media refers to a state in which the plurality of recording media are conveyed into the transfer portion while overlapping each other, and the single feeding of the recording medium refers to a state in which the single recording medium is conveyed alone into the transfer portion.

FIG. 3B is a schematic view for illustrating an example of a graph for showing the relationship between the compression amount of each of the transfer body and the buckling member, and the pressure when the buckling member shows the characteristics of the formula (1), the formula (3), and the formula (4).

The multi-feeding of the recording media further increases the compression amount of each of the transfer body and the buckling member by the T1 as compared to that at the time of the normal operation. The value obtained by subtracting the difference (X4−X2) between the compression amount of the transfer body at the time of the abnormal operation and that at the time of the normal operation from the T1 is a value equal to the difference (X3−X1) between the compression amount of the buckling member at the time of the abnormal operation and that at the time of the normal operation. Accordingly, in the formula (4), a required buckling member can be specified from the compression amount of the transfer body.

In addition, when the abnormal operation is due to the missetting of the thickness of the recording medium, the X3−X1 in the formula (2) described in the foregoing is a value obtained by subtracting the difference between the compression amount of the transfer body at the time of the abnormal operation and that at the time of the normal operation from a value obtained by subtracting a misset value T3 of the thickness of the recording medium from the thickness T2 of the recording medium (i.e., T2−T3−(X4−X2)). Therefore, when the abnormal operation is due to the missetting of the thickness of the recording medium, a buckling member satisfying the following formula (5) instead of the formula (2) described in the foregoing is preferably used.

$$(Y1/X1)/[(Y2-Y1)/\{T2-T3-(X4-X2)\}]\geq 5.0, \text{ provided that } T2-T3>0 \quad \text{Formula (5):}$$

In the formula (5), Y1 represents the pressure at the transfer portion at the time of normal operation, Y2 represents the pressure at the transfer portion at the time of abnormal operation, X1 represents the compression amount of the buckling member for the pressure at the transfer portion at the time of normal operation, X2 represents the compression amount of the transfer body for the pressure at the transfer portion at the time of normal operation, X4 represents the compression amount of the transfer body for the pressure at the transfer portion at the time of the abnormal operation, T2 represents the thickness of the recording medium, and T3 represents a misset value of the thickness of the recording medium.

The T2 represents the thickness of the recording medium to be actually conveyed to the transfer portion, and the missetting of the thickness of the recording medium is caused by using the T3 smaller than the T2 without using the T2 at the time of the presetting of the transfer pressure. FIG. 3C is a schematic view for illustrating an example of a graph for showing the relationship between the compression amount of each of the transfer body and the buckling member, and the pressure when the buckling member shows the characteristics of the formula (1), the formula (3), and the formula (5).

The missetting of the thickness of the recording medium further increases the compression amount of each of the transfer body and the buckling member by the T2−T3 as compared to that at the time of the normal operation. The value obtained by subtracting the difference (X4−X2) between the compression amount of the transfer body at the time of the abnormal operation and that at the time of the normal operation from the T2−T3 is a value equal to the difference (X3−X1) between the compression amount of the buckling member at the time of the abnormal operation and that at the time of the normal operation. Accordingly, in the formula (5), a required buckling member can be specified from the compression amount of the transfer body.

The pore amount of the buckling member is preferably larger than the increment in thickness (X3+X4−X1−X2, T1, or T2−T3) of the recording medium to be caused at the time of the abnormal operation. The pore amount when the abnormal operation is the multi-feeding of the recording media preferably satisfies the following formula (6) with respect to an increment in thickness of the recording media due to the multi-feeding to the transfer portion as compared to single feeding. The pore amount when the abnormal operation is due to the missetting of the thickness of the recording medium preferably satisfies the following formula (7).

$$P/T1 \geq 1.9 \qquad \text{Formula (6):}$$

In the formula (6), P represents the pore amount of the buckling member, and T1 represents the increment in thickness of the recording media due to the multi-feeding to the transfer portion as compared to the single feeding.

$$P/(T2-T3) \geq 1.9 \qquad \text{Formula (7):}$$

In the formula (7), P represents the pore amount of the buckling member, T2 represents the thickness of the recording medium, and T3 represents the misset value of the thickness of the recording medium.

When the pore amount falls within the range represented by any such formula, the pore amount falls within such a range that the miniaturization of the buckling member that the pore is reduced by the thickness reduction of the buckling member is suppressed, and hence an abrupt increase in pressure due to the compression of the buckling member can be further suppressed. The term "pore amount of the buckling member" as used herein refers to a value obtained by converting the amount of pores in the buckling member in terms of thickness. In the case of, for example, a buckling member having a thickness of 1.0 mm and a porosity of 0.90, its pore amount is $1.0 \times 0.90 = 9.0 \times 10^{-1}$ mm.

The buckling member is preferably a porous body using a metal, a ceramics, or a resin as a parent material. Of those, a metal porous body is preferred in terms of compression characteristics and durability. The metal porous body may be produced by a known production method. A method of producing the metal porous body is, for example, a plating method involving: subjecting a resin porous body, such as a urethane foam, to a conductive treatment with a conductor, such as carbon powder; then electrodepositing a metal through plating; and finally eliminating the resin foam and the conductor to provide the metal porous body. In addition, the buckling member may be a composite member, such as a member having a honeycomb sandwich structure in which a honeycomb structural body is sandwiched between plate materials so that a predetermined compression amount may be obtained, or a resin kneaded with hollow particles.

The buckling member may be used as a member forming the transfer body, the support member for a transfer body, or the support member for a recording medium, or as a member separate from those described above in the construction of the apparatus.

In addition, the compression amount X1 of the buckling member at the transfer pressure at the time of the normal transfer is preferably $0.1 \times 10^{-2}$ mm or more to $1.6 \times 10^{-2}$ mm or less, and the compression amount X3 of the buckling member at the time of the abnormal operation is preferably $1.0 \times 10^{-1}$ mm or more to 3.0 mm or less. In addition, the compression amount X4 of the transfer body at the time of the abnormal operation is preferably $0.1 \times 10^{-2}$ mm or more to 1.0 mm or less. In addition, the pressure Y2 produced between the transfer body and the recording medium at the time of the abnormal operation is preferably more than 1.0 MPa to less than 8.0 MPa, and more preferably 3.0 MPa or more to 5.0 MPa or less. In addition, the pore amount P of the buckling member is preferably 1.0 mm or more to 5.0 mm or less.

<Recording Medium>

The recording medium is not limited to paper to be used in general printing (e.g., cast-coated paper, art-coated paper, matt-coated paper, embossed paper, uncoated paper, wood-free paper, plain paper, or recycled paper), and examples thereof may include a cloth, a plastic, and a film. The recording medium may be cut into a desired size in advance. In addition, a sheet wound in a roll shape, which is cut into a desired size after image recording, may be used as the recording medium.

[Fixing Portion]

The image recording apparatus according to the present invention may include a fixing portion configured to fix the image transferred after the transferring step in the transfer portion to the recording medium. A known fixing device may be used as a fixing device to be used in the fixing portion. Of such fixing devices, a fixing device having a fixing roller for pressure fixation is preferred. The fixing roller is preferably heated. When the image is pressurized with the heated fixing roller, the fastness of the image can be improved. In addition, when the pressure, temperature, and surface shape of the fixing roller are adjusted, the smoothness of not only an image portion but also a non-image portion where the liquid composition transferred from the transfer body onto the recording medium is present can be controlled, and hence the glossiness thereof can be controlled.

[Cleaning Portion]

The image recording apparatus according to the present invention may include a cleaning portion configured to clean the surface of the transfer body that has undergone the transferring step by the transfer portion. Any one of the methods that have heretofore been used may be used as a method of cleaning the transfer body. Specific examples thereof include: a method involving applying a cleaning liquid in a shower form to the transfer body; a method involving bringing a wet molleton roller into abutment with the transfer body to wipe off a residue on the transfer body; a method involving bringing the transfer body into contact with the surface of the cleaning liquid; a method involving wiping off the residue on the transfer body with a wiper blade; a method involving applying various kinds of energy to the transfer body; and a method in which two or more of the methods are combined.

Figure 1B:
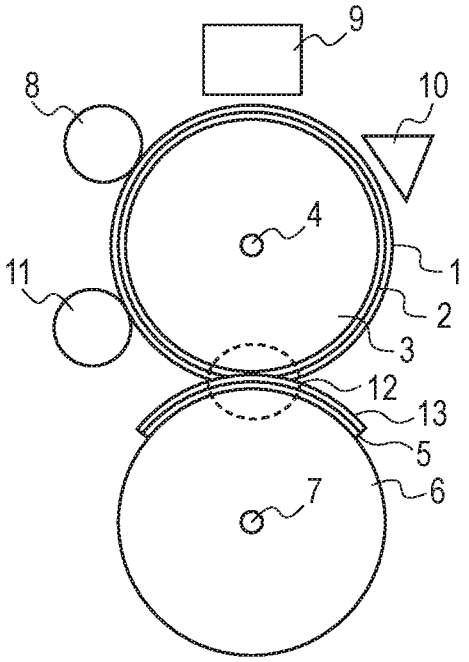
FIG. 1B is a schematic view for illustrating an example of the state of the image recording apparatus according to the present invention, and is a schematic view for illustrating an example of the state of the apparatus at the time of abnormal operation.

An example of the construction of the image recording apparatus according to the present invention is illustrated in each of FIG. 1A and FIG. 1B.

FIG. 1A and FIG. 1B are each a schematic sectional view of the main portion of the image recording apparatus in a plane vertical to the rotary center shafts of a roller-shaped support member for a transfer body and a roller-shaped support member for a recording member in the image recording apparatus. The state of the transfer portion at the time of its normal operation is illustrated in FIG. 1A, and the state of the transfer portion at the time of its abnormal operation due to the multi-feeding of the recording media is illustrated in FIG. 1B. The image to be formed on the transfer body and the final image transferred onto the recording medium are omitted.

The apparatus illustrated in each of FIG. 1A and FIG. 1B includes a sheet-shaped transfer body 1 arranged on the outer peripheral surface of a support member 3 and a support member 6, and the transfer body 1 and the support member 6 are arranged so that the support member 6 may rotate in sync with the transfer body 1. A sheet-shaped buckling member 2 is arranged between the support member 3 and the transfer body 1. A rotary center shaft 4 of the support member 3 for a transfer body and a rotary center shaft 7 of the support member 6 for a recording medium 5 are arranged parallel to each other with a predetermined distance therebetween.

A liquid composition applying portion 8, an image forming portion 9, a liquid removing portion 10 for an image, and a cleaning portion 11 are arranged around the support member 3 from an upstream portion toward a downstream portion in the conveying direction of the transfer body 1. Those respective portions are adjusted so as to be actuated in association with the movement of the image forming surface of the transfer body 1 in association with the rotation of the support member 3.

A transfer portion 12 is formed of a nip portion formed by the support member 3 and the support member 6.

Figures 2A, 2B:
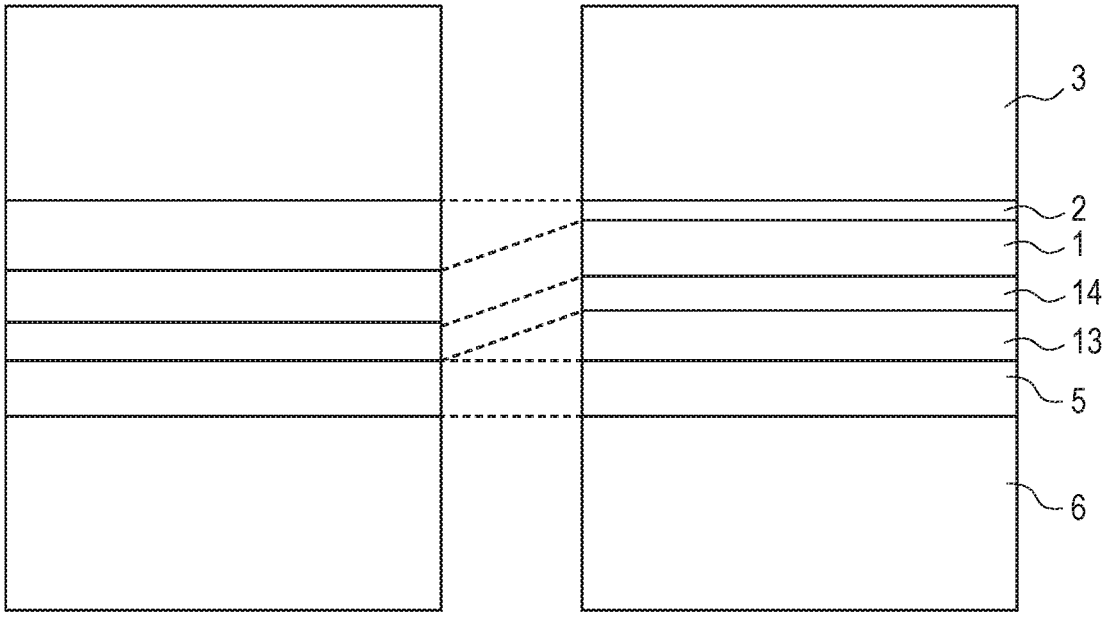
FIG. 2A is a schematic view for illustrating an example of the state of the transfer portion of the image recording apparatus according to the present invention, and is a schematic view for illustrating an example of the state of the transfer portion at the time of normal operation.
FIG. 2B is a schematic view for illustrating an example of the state of the transfer portion of the image recording apparatus according to the present invention, and is a schematic view for illustrating an example of the state of the transfer portion at the time of the abnormal operation.

Enlarged views of the states of the transfer portion illustrated in FIG. 1A and FIG. 1B are illustrated in FIG. 2A and FIG. 2B, respectively. In each of FIG. 2A and FIG. 2B, the surfaces of the respective support members are illustrated as planes for convenience.

As illustrated in FIG. 2A, at the time of the normal operation, that is, when the sheet-shaped recording medium 5 is inserted alone into the nip portion formed in the transfer portion, a state in which the buckling member 2, the transfer body 1, an image 14, and the recording medium 5 are sandwiched between the support member 3 and the support member 6 is established. In the state, the compressive layer of the transfer body is mainly compressed to produce a transfer pressure.

In contrast, when the recording medium 5 is erroneously inserted into the nip portion under a state in which another recording medium 13 (multi-fed recording medium 13) is overlapped thereon as illustrated in FIG. 2B, an increment in thickness is caused by the multi-fed recording medium. The arrangement positions of the support member 3 and the support member 6 (distance between the members) do not change, and hence a pressure in the nip portion increases. The buckling member 2 is compressed in correspondence with the increase in pressure to absorb the increment in pressure, and hence the occurrence of a load to the support member for a transfer body due to the increment in pressure can be reduced.

According to the present invention, the image recording apparatus having the following features can be provided: at the time of abnormal operation, a load applied to the image recording apparatus is reduced, and hence the damage and deformation of the image recording apparatus are suppressed; and even in normal transfer, the apparatus has high transfer efficiency and hence can suppress a reduction in image quality.

EXAMPLES

The present invention is described in more detail below by way of Examples and Comparative Examples. The present invention is by no means limited by the following examples as long as its modifications do not deviate from the gist of the present invention. In the following description of Examples, the term "part(s)" is on a mass basis unless otherwise stated.

[Preparation of Resin Particle Dispersion]

<Preparation of Resin Particle Dispersion P1>

Ethyl methacrylate (18 parts), 2,2'-azobis-(2-methylbutyronitrile) (2 parts), and n-hexadecane were mixed (2 parts), and the mixture was stirred for 0.5 hour. The mixture was dropped in 78 parts of a 6% by mass aqueous solution of NIKKOL BC20 (product name, manufactured by Nikko Chemicals Co., Ltd.) serving as an emulsifying agent, and the whole was stirred for 1.0 hour. Next, the resultant was irradiated with an ultrasonic wave from an ultrasonic irradiator for 5.0 hours. Subsequently, the irradiated product was subjected to a polymerization reaction under a nitrogen atmosphere at 85° C. for 3 hours, and the resultant was cooled to room temperature and then filtered. Thus, a resin particle dispersion P1 having a resin content of 20.0% by mass was prepared. Resin particles in the P1 had a minimum film forming temperature of 110° C. and an average particle diameter of 0.2 μm.

[Preparation of Ink]

<Preparation of Pigment Dispersion>

Carbon black (product name: MONARCH 1100, manufactured by Cabot) (10 parts), a resin aqueous solution (styrene-ethyl acrylate-acrylic acid copolymer, acid value: 150, weight-average molecular weight: 8,000, prepared by neutralizing an aqueous solution having a resin content of 20.0% by mass with an aqueous solution of potassium hydroxide) (15 parts), and pure water (75 parts) were mixed, and the mixture was loaded into a batch-type vertical sand mill (manufactured by Aimex Co., Ltd.). Zirconia beads each having a diameter of 0.3 mm (200 parts) were filled into the sand mill, and the mixture was subjected to a dispersion treatment for 5 hours while being cooled with water. Coarse particles were removed by centrifuging the dispersed liquid. After that, a pigment dispersion having a pigment content of 10.0% by mass was obtained.

<Preparation of Ink>

The resin particle dispersion P1 obtained in the foregoing (50.0% by mass), the pigment dispersion (20.0% by mass), glycerin (10.0% by mass), AE100 (1.0% by mass), and ion-exchanged water (19.0% by mass) were mixed. The materials were sufficiently stirred to be dispersed, and then the resultant was filtered under pressure with a microfilter having a pore size of 3.0 μm. Thus, each ink was prepared.

The term "AE100" refers to a surfactant ACETYLENOL E100 (product name) manufactured by Kawaken Fine Chemicals Co., Ltd.

[Preparation of Liquid Composition (Reaction Liquid)]

Levulinic acid (10.0 percent by mass), NMO (2.0% by mass), F-444 (7.0% by mass), and ion-exchanged water (81.0% by mass) were mixed, and the materials were sufficiently stirred to be dispersed. Thus, a reaction liquid was prepared. The term "NMO" refers to N-methylmorpholine N-oxide, and the term "F-444" (product name) refers to a fluorine-based surfactant manufactured by DIC Corporation.

[Arrangement of Transfer Body and Buckling Member]

A stainless-steel drum was used as a support member for a transfer body. A buckling member was arranged on the drum, and a transfer body was further arranged thereon. The buckling member was selected from buckling members 1 to 4 shown in Table 1, and the transfer body was selected from transfer bodies 1 and 2 shown in Table 2-1 and Table 2-2. Buckling members each obtained by subjecting CELMET (product name, Sumitomo Electric Industries, Ltd.) to processing, such as polishing or pressurization, so as to have physical properties shown in Table 1 were prepared as the buckling members 1 to 4.

Combinations of the buckling member and the transfer body are shown in Tables 3-1 and 3-2.

[The Calculation Method of the Porosity of the Buckling Member]

The porosity of the buckling member was determined by using the following formula A.

1−(mass of buckling member/density of material for buckling member excluding pores/volume of buckling member including pores) Formula A:

[The Measurement Method of the Compression Amount and the Pressure]

A compression amount and a pressure were measured by an ordinary method with a compression tester (product name: FSR-1000, Rhesca Co., Ltd.) having a displacement meter and a load cell. The measurement of the compression amount was performed at room temperature (about 25° C.) by mounting a sheet-shaped buckling member and/or transfer body on the measurement support portion of the compression tester. Changes in compression amount and pressure shown in each of FIG. 3A to FIG. 3C by the solid line are each obtained by performing the measurement through the use of a laminated product obtained by laminating the buckling member and the transfer body in the stated order as a measurement sample.

When the respective layers of the transfer body are joined to each other, any one of the layers may be directly formed on the other layer, or the respective layers may be formed before being joined to each other by means of, for example, an adhesive or a double-sided tape. In each of the transfer body 1 and the transfer body 2, a compressive layer was joined to a reinforcing layer by direct formation, and a recording layer was joined to the compressive layer with an adhesive. In addition, the transfer body, which was of a sheet shape, was arranged on the support member, which was of a roller shape, by: winding the transfer body around the support member via the buckling member; and fixing the end portions of the transfer body to the support member. A condensation polymer of siloxane compounds shown in Table 2-1 was arranged on the recording layer of the transfer body by the following method.

First, glycidoxypropyltriethoxysilane and methyltriethoxysilane were mixed at a molar ratio of 1:1, and the mixture was heated to reflux in a water solvent through the use of hydrochloric acid as a catalyst for 24 hours or more. Thus, a solution of a hydrolyzable condensate was obtained. Next, the solution of the hydrolyzable condensate was diluted to 10% by mass to 20% by mass with methyl isobutyl ketone, and a photocationic polymerization initiator SP-150 (product name, manufactured by Adeka Corporation) was added at 5% by mass with respect to the solid content of such solution. Thus, a coating solution was obtained. The surface of a silicone rubber (obtained by molding a silicone rubber having a durometer type A hardness of 60° (KE-106, manufactured by Shin-Etsu Chemical Co., Ltd.) into a thickness of 1.0×10−1 mm) serving as a substrate was subjected to a plasma treatment, and then the coating solution was applied to the treated surface to provide a coat layer. Further, a surface layer was formed by curing the coat layer as follows: the surface was exposed to light from a UV lamp, and was heated at 150° C. for 2 hours. Thus, a recording layer for a transfer body was obtained. The surface layer (film formed of the cured product of the condensate of the siloxane compounds) of the resultant recording layer for a transfer body had a thickness of about 0.8 μm.

TABLE 1

| | Material | Porosity | Thickness (mm) | Pore amount (mm) | Compression amount at each pressure (mm) | | | | |
|---|---|---|---|---|---|---|---|---|---|
| | | | | | 1.0 MPa | 2.0 MPa | 3.0 MPa | 5.0 MPa | 8.0 MPa |
| Buckling member 1 | Nickel | 0.95 | 1.6 | 1.5 | $2.8 \times 10^{-2}$ | $6.0 \times 10^{-2}$ | $3.3 \times 10^{-1}$ | $7.5 \times 10^{-1}$ | 1.2 |
| Buckling member 2 | Nickel | 0.94 | 1.3 | 1.2 | $1.5 \times 10^{-2}$ | $5.0 \times 10^{-2}$ | $2.2 \times 10^{-1}$ | $4.1 \times 10^{-1}$ | $4.8 \times 10^{-1}$ |
| Buckling member 3 | Nickel | 0.95 | 2.0 | 1.9 | $3.0 \times 10^{-2}$ | $5.9 \times 10^{-1}$ | 1.0 | 1.4 | 1.6 |
| Buckling member 4 | Nickel | 0.95 | $8.0 \times 10^{-1}$ | $7.6 \times 10^{-1}$ | $0.9 \times 10^{-2}$ | $4.5 \times 10^{-2}$ | $2.0 \times 10^{-1}$ | $2.1 \times 10^{-1}$ | $2.2 \times 10^{-1}$ |

TABLE 2-1

| | Reinforcing layer | | Compressive layer | | Recording layer | |
|---|---|---|---|---|---|---|
| | Material | Thickness (mm) | Material | Thickness (mm) | Material | Thickness (mm) |
| Transfer body 1 | PET | $2.5 \times 10^{-1}$ | Hard silicone rubber sponge | 2.0 | Silicone rubber having cured product layer of condensate of siloxane compounds arranged on its surface | $1.0 \times 10^{-1}$ |
| Transfer body 2 | PET | $2.5 \times 10^{-1}$ | Soft silicone rubber sponge | 2.0 | Silicone rubber having cured product layer of condensate of siloxane compounds arranged on its surface | $1.0 \times 10^{-1}$ |

PET: polyethylene terephthalate

TABLE 2-2

| | Compression amount at each pressure (mm) | | | | | |
|---|---|---|---|---|---|---|
| | 0.2 MPa | 1.0 MPa | 2.0 MPa | 3.0 MPa | 5.0 MPa | 8.0 MPa |
| Transfer body 1 | $2.0 \times 10^{-2}$ | $1.4 \times 10^{-1}$ | $2.1 \times 10^{-1}$ | $2.7 \times 10^{-1}$ | $3.7 \times 10^{-1}$ | $5.2 \times 10^{-1}$ |
| Transfer body 2 | $1.4 \times 10^{-1}$ | $5.3 \times 10^{-1}$ | $8.1 \times 10^{-1}$ | 1.1 | 1.6 | 1.7 |

[Image Recording and Evaluation Result]

<Formation of Image>

The ink obtained in the foregoing was filled into an ink cartridge, and the cartridge was mounted on an inkjet device having a recording head of an inkjet system, which was arranged in the image forming portion 9 of the image recording apparatus having a construction illustrated in each of FIG. 1A and FIG. 1B. The formation of an image on the transfer body and the transfer of the image onto a recording medium in the apparatus were performed as described below.

First, the reaction liquid obtained in the foregoing was applied at 2.0 g/m$^2$ to the transfer body 1 with an application roller arranged in the liquid composition applying portion 8.

Next, at least part of moisture in the reaction liquid layer on the transfer body 1 was evaporated with a blast from a blower (not shown). The ink was ejected from the recording head of the inkjet system onto the transfer body 1 to record an image. A solid image formed in a range measuring 1 cm by 1 cm was used as an ejection pattern serving as the image. The following recording condition was used in the formation of the image: one ink droplet having a mass of 4 ng was applied at a resolution of 1,200 dpi×1,200 dpi to a unit region measuring 1/1,200 inch by 1/1,200 inch.

<Evaluation of Transfer Efficiency>

Next, at least part of moisture in the image was removed by heating the temperature of the image to 100° C. by heating device as the liquid removing portion 10. Further, the transfer body was heated with a heating mechanism (not shown) to adjust the temperature of the image to 120° C., and the recording medium 5 was pressed against the image at a speed of 0.5 m/sec. The distance along which the transfer body 1 and the recording medium 5 are in contact with each other is 20 mm in the conveying direction of the transfer body, and hence the time period for which the transfer body and the recording medium are in contact with each other is 40 milliseconds. A transfer pressure was produced by a compression amount (X1+X2) shown in Table 3-1 under a state in which the support member 3 (of a roller shape) for a transfer body and the support member 6 (of a roller shape) for a recording medium were arranged so that a distance between the rotary center shaft 4 of the support member 3 and the rotary center shaft 7 of the support member 6 was kept constant at a predetermined length. After the image had been transferred onto the recording medium 5 as described above, transfer efficiency in the first image forming process was evaluated from the image remaining on the surface of the transfer body.

Further, the series of image forming process was repeated ten times with the cleaning of the transfer body by contacting the sponge roller containing water after the transfer of the image. After that, transfer efficiency in the tenth image forming process was evaluated from the image remaining on the surface of the transfer body. Evaluation criteria are as described below. In the present invention, in the following evaluation criteria, a level A was defined as a preferred level, and a level B was defined as an unacceptable level. The evaluation results are shown in Table 3-2.

A: No conspicuous remaining of the image on a transfer body side is observed with the eyes.

B: Conspicuous remaining of the image on the transfer body side is observed with the eyes.

<Evaluation of Image Quality of Final Image>

With regard to the image quality of the final image transferred onto a recording medium, a difference in shape between a mirror image obtained by reversing the ejection pattern and the final image was evaluated. After the image forming process had been performed ten times, the evaluation was performed by using an image formed on the recording medium in the tenth process as the final image. Evaluation criteria are as described below. In the present invention, in the following evaluation criteria, a level A was defined as an acceptable level, and a level B was defined as an unacceptable level. The evaluation results are shown in Table 3-2.

A: No conspicuous shape difference is observed with the eyes.

B: A conspicuous shape difference is observed with the eyes.

The recording medium is "DEEP MAT (product name, ream weight: 450 kg, thickness: 0.68 mm, manufactured by Heiwa Paper Co., Ltd.)."

<Evaluation of Load Applied to Image Recording Apparatus at Time of Abnormal Operation>

On the assumption that recording media were multi-fed, under a condition shown in Table 3-2, the transfer body and the recording medium were laminated and inserted into the nip portion of rollers facing each other to be pressurized, followed by the evaluation of a load applied to the support member for a transfer body. Examples 1 and 3, and Comparative Examples 1 to 5 are each a case in which two recording media were multi-fed, that is, a case in which one extra recording medium was multi-fed, and hence an increment in thickness corresponds to the thickness of one recording medium. Example 2 is a case in which three recording media were multi-fed, that is, a case in which two extra recording media were multi-fed, and hence an increment in thickness corresponds to the thickness of two recording media.

The respective conditions at the time of abnormal operation are shown in Table 3-2. The value of the left side of the formula (4) in Table 3-2 was equal to the value of the left side of the formula (2).

In addition, in the evaluation, the value of the pressure Y2 produced between the transfer body and the recording medium at the time of the abnormal operation was adopted as the load applied to the support member for a transfer body.

Evaluation criteria are as described below. In the present invention, in the following evaluation criteria, levels A and B were defined as acceptable levels, and a level C was defined as an unacceptable level. The evaluation results are shown in Table 3-2. In each of Examples each corresponding to the level A or B, the transfer efficiency and the image quality of the final image were improved by exchanging the buckling member after the abnormal operation. In addition, similar results were obtained in the missetting of the thickness of the recording medium.

A: The load applied to the support member for a transfer body was less than 5.0 MPa.

B: The load applied to the support member for a transfer body was 5.0 MPa or more to less than 8.0 MPa.

C: The load applied to the support member for a transfer body was 8.0 MPa or more.

TABLE 3-1

| | | P: Pore amount of buckling member (mm) | | At time of normal operation (first image forming process) | | | |
|---|---|---|---|---|---|---|---|
| | | | | Compression amount (mm) | | | |
| | Buckling member | | Transfer body | X1 (Buckling member) | X2 (Transfer body) | Left side of formula (1) | Pressure (MPa) Y1 |
| Example 1 | Buckling member 1 | 1.5 | Transfer body 1 | $2.8 \times 10^{-2}$ | $1.4 \times 10^{-1}$ | 0.20 | 1.0 |
| Example 2 | Buckling member 1 | 1.5 | Transfer body 1 | $2.8 \times 10^{-2}$ | $1.4 \times 10^{-1}$ | 0.20 | 1.0 |
| Example 3 | Buckling member 2 | 1.2 | Transfer body 1 | $1.5 \times 10^{-2}$ | $1.4 \times 10^{-1}$ | 0.11 | 1.0 |
| Comparative Example 1 | — | — | Transfer body 1 | — | $1.4 \times 10^{-1}$ | — | 1.0 |
| Comparative Example 2 | — | — | Transfer body 2 | — | $1.4 \times 10^{-1}$ | — | 0.2 |
| Comparative Example 3 | — | — | Transfer body 2 | — | $5.3 \times 10^{-1}$ | — | 1.0 |
| Comparative Example 4 | Buckling member 3 | 1.9 | Transfer body 1 | $3.0 \times 10^{-2}$ | $1.4 \times 10^{-1}$ | 0.21 | 1.0 |
| Comparative Example 5 | Buckling member 4 | $7.6 \times 10^{-1}$ | Transfer body 1 | $0.9 \times 10^{-2}$ | $1.4 \times 10^{-1}$ | 0.06 | 1.0 |

TABLE 3-2

| | At time of abnormal operation | | | | | | Evaluation result | | | |
|---|---|---|---|---|---|---|---|---|---|---|
| | Increment in thickness (mm) | Compression amount (mm) | | | | | Transfer efficiency | | Image quality | |
| | T1 | X3 (Buckling member) | X4 (Transfer body) | Pressure (MPa) Y2 | Left side of formula (4) | Left side of formula (6) | First image forming process | Tenth image forming process | Tenth image forming process | Load |
| Example 1 | $6.8 \times 10^{-1}$ | $5.1 \times 10^{-1}$ | $3.4 \times 10^{-1}$ | 3.6 | 6.6 | 2.2 | A | A | A | A |
| Example 2 | 1.4 | 1.1 | $5.0 \times 10^{-1}$ | 7.9 | 5.5 | 1.1 | A | A | A | B |
| Example 3 | $6.8 \times 10^{-1}$ | $4.5 \times 10^{-1}$ | $3.9 \times 10^{-1}$ | 5.3 | 6.7 | 1.8 | A | A | A | B |
| Comparative Example 1 | $6.8 \times 10^{-1}$ | — | $8.2 \times 10^{-1}$ | >10.0 | — | — | A | A | A | C |
| Comparative Example 2 | $6.8 \times 10^{-1}$ | — | $8.2 \times 10^{-1}$ | 2.1 | — | — | B | B | B | A |
| Comparative Example 3 | $6.8 \times 10^{-1}$ | — | 1.2 | 3.5 | — | — | A | A | B | A |
| Comparative Example 4 | $6.8 \times 10^{-1}$ | $6.2 \times 10^{-1}$ | $2.3 \times 10^{-1}$ | 2.2 | 16.4 | 2.8 | A | B | B | A |
| Comparative Example 5 | $6.8 \times 10^{-1}$ | $2.3 \times 10^{-1}$ | $6.0 \times 10^{-1}$ | 8.9 | 3.1 | 1.1 | A | A | A | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-071121, filed Apr. 2, 2018, which is hereby incorporated by reference herein in its entirety.

What is claimed is:

1. An image recording apparatus comprising:

a transfer body;

a support member for a transfer body configured to support the transfer body;

an image forming portion configured to form an image by applying ink to the transfer body;

a transfer portion configured to transfer the image formed on the transfer body onto a recording medium by applying a pressure to the image; and a support member for a recording medium configured to support the recording medium, wherein the image recording apparatus further comprises a buckling member satisfying the following formula (1) to the following formula (3) in at least one of a space between the transfer body and the support member for a transfer body, or a space between the recording medium and the support member for a recording medium:

$$X1/X2 \leq 0.20 \quad \text{Formula (1):}$$

$$(Y1/X1)/\{(Y2-Y1)/(X3-X1)\} \geq 5.0 \quad \text{Formula (2):}$$

$$Y1 < Y2 \quad \text{Formula (3):}$$

in the formulae (1) to (3), Y1 represents a pressure at the transfer portion at a time of normal operation, Y2 represents a pressure at the transfer portion at a time of abnormal operation, X1 represents a compression amount of the buckling member for the pressure at the transfer portion at the time of normal operation, X2 represents a compression amount of the transfer body for the pressure at the transfer portion at the time of normal operation, and X3 represents a compression amount of the buckling member for the pressure at the transfer portion at the time of the abnormal operation.

2. The image recording apparatus according to claim 1, wherein the abnormal operation comprises multi-feeding of the recording media, and the buckling member satisfies the following formula (4) instead of the formula (2):

$$(Y1/X1)/[(Y2-Y1)/\{T1-(X4-X2)\}]\geq 5.0 \quad \text{Formula (4):}$$

in the formula (4), Y1 represents the pressure at the transfer portion at the time of normal operation, Y2 represents the pressure at the transfer portion at the time of abnormal operation, X1 represents the compression amount of the buckling member for the pressure at the transfer portion at the time of normal operation, X2 represents a compression amount of the transfer body for the pressure at the transfer portion at the time of normal operation, X4 represents a compression amount of the transfer body for the pressure at the transfer portion at the time of the abnormal operation, and T1 represents an increment in thickness of the recording media due to the multi-feeding to the transfer portion as compared to single feeding.

3. The image recording apparatus according to claim 2, wherein the buckling member has a pore amount satisfying the following formula (6) with respect to a total thickness of the multi-fed recording media:

$$P/T1\geq 1.9 \quad \text{Formula (6):}$$

in the formula (6), P represents the pore amount of the buckling member, and T1 represents the increment in thickness of the recording media due to the multi-feeding to the transfer portion as compared to the single feeding.

4. The image recording apparatus according to claim 1, wherein the transfer pressure is preset by a thickness of the recording medium, the abnormal operation is due to missetting of the thickness of the recording medium, and the buckling member satisfies the following formula (5) instead of the formula (2):

$$(Y1/X1)/[(Y2-Y1)/\{T2-T3-(X4-X2)\}]\geq 5.0, \text{ provided that } T2-T3>0 \quad \text{Formula (5):}$$

in the formula (5), Y1 represents the pressure at the transfer portion at the time of normal operation, Y2 represents the pressure at the transfer portion at the time of abnormal operation, X1 represents the compression amount of the buckling member for the pressure at the transfer portion at the time of normal operation, X2 represents the compression amount of the transfer body for the pressure at the transfer portion at the time of normal operation, X4 represents the compression amount of the transfer body for the pressure at the transfer portion at the time of the abnormal operation, T2 represents the thickness of the recording medium, and T3 represents a misset value of the thickness of the recording medium.

5. The image recording apparatus according to claim 4, wherein the buckling member has a pore amount represented by the following formula (7) with respect to the missetting of the thickness of the recording medium:

$$P/(T2-T3)\geq 1.9 \quad \text{Formula (7):}$$

in the formula (7), P represents the pore amount of the buckling member, T2 represents the thickness of the recording medium, and T3 represents the misset value of the thickness of the recording medium.

6. The image recording apparatus according to claim 1, wherein the compression amount X2 of the transfer body for the pressure at the transfer portion at the time of normal operation is $5.0\times10^{-2}$ mm or more to $5.0\times10^{-1}$ mm or less.

7. The image recording apparatus according to claim 1, wherein the buckling member comprises a metal porous body.

8. The image recording apparatus according to claim 1, wherein a system of the formation of the image by applying the ink to the transfer body comprises an inkjet system.

* * * * *